US008100342B1

(12) United States Patent
Burkhardt et al.

(10) Patent No.: US 8,100,342 B1
(45) Date of Patent: Jan. 24, 2012

(54) SHALLOW FLANGEWAY RAIL SEAL

(75) Inventors: Bruce E. Burkhardt, Conestogo (CA); Richard T. Ellis, Kitchener (CA)

(73) Assignee: Polycorp Inc., Toronto (CA)

( * ) Notice: Subject to any disclaimer, the term of this patent is extended or adjusted under 35 U.S.C. 154(b) by 0 days.

(21) Appl. No.: 12/826,761

(22) Filed: Jun. 30, 2010

(51) Int. Cl.
*E01B 1/00* (2006.01)

(52) U.S. Cl. ..... 238/8; 238/9; 238/283; 238/264

(58) Field of Classification Search ..... 238/2–9, 238/17, 121, 122, 140, 143, 147; 246/456, 246/457, 460
See application file for complete search history.

(56) References Cited

U.S. PATENT DOCUMENTS

| | | | | |
|---|---|---|---|---|
| 4,641,779 | A * | 2/1987 | O'Brien et al. | 238/7 |
| 5,609,294 | A * | 3/1997 | Lucas, Jr. | 238/9 |
| 6,068,195 | A * | 5/2000 | Gaudet | 238/8 |
| 6,129,288 | A * | 10/2000 | Petersen et al. | 238/8 |
| 6,293,473 | B1 * | 9/2001 | Ortwein et al. | 238/2 |
| 6,296,195 | B1 * | 10/2001 | Blank et al. | 238/2 |
| 6,588,677 | B2 * | 7/2003 | Hofstetter et al. | 238/283 |
| 6,701,594 | B2 * | 3/2004 | Bruyn | 29/257 |
| 6,705,536 | B1 * | 3/2004 | Birt et al. | 238/8 |
| 6,726,116 | B2 * | 4/2004 | Hofstetter, Sr. | 238/8 |
| 6,764,021 | B1 * | 7/2004 | Birt et al. | 238/2 |
| 6,871,791 | B1 * | 3/2005 | Egan, Jr. | 238/8 |
| 7,484,669 | B2 * | 2/2009 | Gray, Jr. | 238/3 |
| 7,677,465 | B1 * | 3/2010 | Bruning | 238/8 |
| 2003/0098359 | A1 * | 5/2003 | Hofstetter, Sr. et al. | 238/109 |
| 2003/0168519 | A1 * | 9/2003 | Hofstetter, Sr. | 238/8 |
| 2005/0023366 | A1 * | 2/2005 | Williams et al. | 238/264 |
| 2011/0084175 | A1 * | 4/2011 | Naquin | 246/415 R |

OTHER PUBLICATIONS

Polycorp, EPFLEX Railseal Interface, brochure, 2000, 1 page, Elora, Ontario, Canada.
Polycorp, Install 500 Feet of Railseal in a Day!, brochure, 2001, 1 page, Elora, Ontario, Canada.
Polycorp, Feature Function Benefit, brochure, 2000, 1 page, Elora, Ontario, Canada.
Polycorp, EPLOCK II The Ultimate Solution, brochure, 1 page, Elora, Ontario, Canada.
Polycorp, Important Installation Instructions, brochure, 2004, 1 page, Elora, Ontario, Canada.
Polycorp, EPFLEX Railseal Intallation Guidelines, brochure, 2000, 1 page, Elora, Ontario, Canada.
Polycorp, Unconditional Guarantee, brochure, 2000, 1 page, Elora, Ontario, Canada.

* cited by examiner

*Primary Examiner* — Joe Morano, IV
*Assistant Examiner* — Jason C Smith
(74) *Attorney, Agent, or Firm* — Marshall & Melhorn LLC

(57) ABSTRACT

A rail seal for sealing the gap between a rail and a concrete panel in a railroad crossing so as to provide a generally even or level surface for vehicular or pedestrian traffic while still providing an appropriate rail structure for receiving and guiding the train wheels along the tracks is provided. More particularly, the upper surface of the rail seal is formed with a recessed portion or flangeway for receiving the flanged-end of a train. The flangeway or recessed portion, however, is formed so that the surface of the flangeway lies in a plane above the bottom of the rail head but below the upper surface of the rail head, thereby providing a "shallow" flangeway. The provision of a "shallow" flangeway helps to reduce the risks associated with vehicular and/or other pedestrian traffic that must access or cross the railroad tracks. Specifically, the shallow flangeway helps to prevent the heels of pedestrian shoes or the smaller width bicycle, stroller or wheelchair wheels from becoming trapped in the gaps typically associated with railroad crossing structures.

20 Claims, 7 Drawing Sheets

SHALLOW FLANGEWAY RAIL SEAL

TECHNICAL FIELD

The present disclosure relates generally to a rail seal for railroad crossings. More particularly, the invention relates to an elastomeric rail seal for sealing the space between a rail and the surrounding platform or road surface or road bed.

BACKGROUND

Railroad or streetcar tracks generally consist of two parallel steel rails that are anchored perpendicularly to tie members (i.e. rail ties) for maintaining a consistent distance or gauge between the two rails. Train or streetcar wheels are generally in the form of conical, flanged wheels with the smaller diameter end of the wheel being located on the outside of the rail and the larger diameter, flanged-end of the wheel being located on the inner or "gauge" side of the rail as the train or streetcar travels over the tracks. The train wheels run along the upper surface of the steel rails with the flanged inner end or larger diameter end of the wheel being guided along the inside edge of the track.

The design and structure of railroad or streetcar crossings where railroad tracks intersect with vehicular roadways or pedestrian crossings can present certain challenges with regard to the competing requirements of rail traffic versus vehicular and/or pedestrian traffic. More specifically, the structure of train wheels requires that a gap be provided along the inside edge of each track to allow the larger diameter end or the flanged-end of the wheels to engage the tracks. The engagement between the flanged-end of the wheel with the inside edge of the rail is how the train stays in contact with the tracks as it travels along the rails.

However, having gaps adjacent the rails can be problematic for vehicles and/or other pedestrian traffic (such as bicycles, wheelchairs or strollers, for example) at railroad or streetcar crossings. Firstly, the gaps create an uneven road surface, which is undesirable for vehicular traffic. As well, the gaps are particularly hazardous to pedestrians walking across the crossing as people's shoes/heels can easily be caught in the gaps causing injury. The same is true with regard to the smaller width wheels or tires that are used for bicycles, wheelchairs and strollers, for example, as the wheels can become lodged or trapped in the gap resulting in a potentially dangerous situation. Having exposed, open gaps can also present the problem of debris, etc. becoming lodged in the gap which could result in derailment of a passing train or streetcar.

Rail seals made of rubber or another elastomeric material are sometimes used in the gap between the rails and the surrounding platform area or road surface to help reduce the size of the gap adjacent the rails. However, the rail seals are often formed with a deep recess or flangeway in the upper surface thereof adjacent the rail head to provide an adequate recess or flangeway for receiving the flanged-end of the train wheel. Accordingly, these rail seals still present the problem of having a deep recess adjacent the rails which can pose a threat to pedestrians, bicycles, strollers and wheelchairs, etc. crossing the tracks.

Accordingly, there is a continuous need to improve the design and structure of public railroad or streetcar crossings to ensure that the requirements of rail traffic, vehicular traffic and pedestrian traffic are met.

SUMMARY OF THE INVENTION

The present disclosure provides an improved rail seal for sealing the gap between a rail and a surrounding platform or road surface in a railroad or streetcar crossing so as to provide a generally even or level surface for vehicular or pedestrian traffic while still providing an appropriate rail structure for receiving and guiding the flanged train wheels along the tracks.

In accordance with one example embodiment of the present disclosure there is provided a rail seal for a railroad crossing, the rail seal for sealing a gap between a rail and a surrounding road surface or platform of a railroad or streetcar crossing, the rail having a rail head, a rail base and a web portion interconnecting the rail head and rail base, the rail seal comprising: an elongated elastomeric seal body; a first surface formed along the length of the seal body for generally abutting a gauge side of the rail; a second surface formed along the length of the seal body generally opposite to said first surface, the second surface generally abutting a corresponding edge of a concrete panel of the railroad crossing; and a flangeway formed in an upper surface of the seal body along the length thereof for receiving a flanged wheel of a train; wherein the flangeway lies in a plane above the bottom of the rail head but below the upper surface of the rail head.

In accordance with another example embodiment of the present disclosure there is provided a railway crossing structure comprising: a pair of rails, each rail having a rail head, a base flange and a web portion interconnecting the rail head and the base flange; a plurality of rail ties secured transversely between the rails; a gauge panel positioned on a gauge side of the rails, the gauge panel forming a first gap between an edge of the panel and the gauge side of the corresponding rail; a pair of field panels, each field panel positioned on a field side of a corresponding rail, each field panel being spaced away from the corresponding rail to form a second gap; a gauge-side rail seal positioned within each first gap, the gauge-side rail seal comprising: an elongated elastomeric seal body; a first surface formed along the length of the seal body for generally abutting a gauge side of the rail; a second surface formed along the length of the seal body generally opposite to said first surface, the second surface generally abutting a corresponding edge of the gauge panel; and a flangeway formed in an upper surface of the seal body along the length thereof for receiving a flanged wheel of a train; wherein the flangeway lies in a plane above the bottom of the rail head but below the upper surface of the rail head.

BRIEF DESCRIPTION OF THE DRAWINGS

Embodiments of the present disclosure will now be described, by way of example only, with reference to the attached Figures, wherein.

Where appropriate, like reference numerals have been used in the drawings to identify similar features.

DETAILED DESCRIPTION OF THE EXAMPLE EMBODIMENTS

Figure 1:
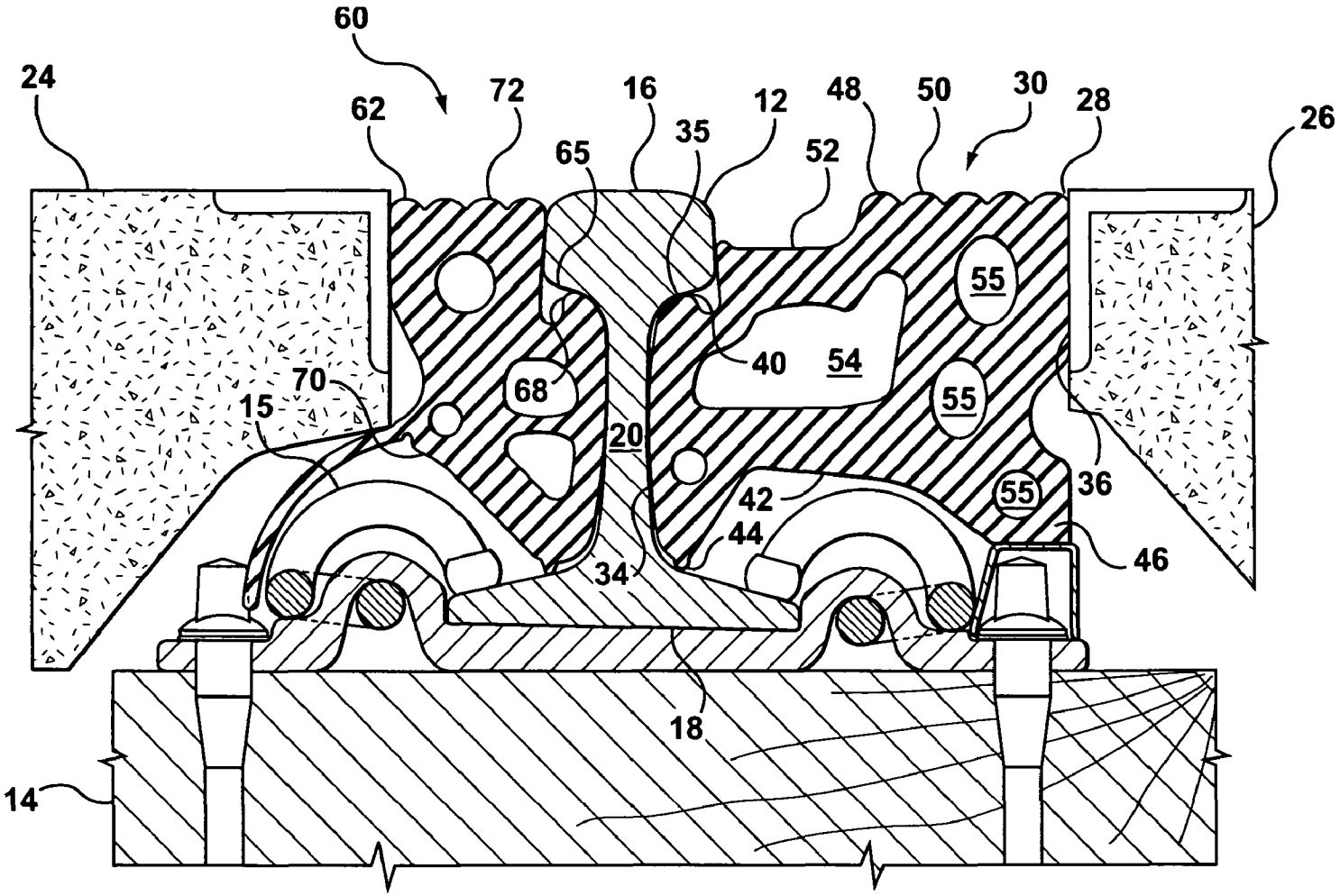
FIG. 1 is a cross-sectional view of a portion of a railway crossing structure incorporating a rail seal according to an example embodiment of the present disclosure.

Referring now to the drawings, there is shown in FIG. 1 a cross-sectional view of a portion of a railway crossing structure incorporating a rail seal according to an example embodiment of the present disclosure. While the description may refer generally to a railway crossing structure, it will be understood that the present disclosure is not limited specifically to railroad crossings, but is also intended to cover various types of rail crossings such as streetcar crossings as well.

The railway crossing structure shown in FIG. 1 includes two parallel rails 12 (only one of which is shown) which are anchored in place by transverse members or rail ties 14 and secured with rail clips 15 to ensure that a consistent distance or gauge is maintained between the rails 12 along the length of the track. The rail 12 is generally in the form of a modified I-beam, with each rail 12 having a rail head 16, a base flange 18 and a web portion 20 interconnecting the rail head 16 and the base flange 18. In standard rail designs, the rail head 16 typically has a height in the range of about 1.25-1.5 inches. At railway (or streetcar) crossings wherein other vehicular traffic and/or pedestrian traffic has access to or is required to cross the tracks, poured asphalt or concrete panels or any other suitable surrounding material are generally used around and in-between the rails to provide a generally even surface to facilitate the crossing of vehicular and/or pedestrian traffic. In the example embodiment shown in FIG. 1, concrete field panels 24 are used and positioned on the outer side of each of the rails 12 and a concrete gauge panel 26 is located in the space between the rails 12, although it will be understood that the rail seal is not limited to use with concrete panels. The gauge panel 26 is sized and positioned between rails 12 to ensure that a sufficient gap 28 is provided along the gauge side or inside edge of the rails to accommodate the flanged-end of the train wheel as it travels along the tracks. The panels 24, 26 are positioned so as to generally be at the same level as the rail head 16 of the rails 12 so as to provide a generally even surface for vehicular traffic travelling over the railway crossing.

A gauge side rail seal 30 is located in the gap 28 provided between the inside surface of the rails 12 and the gauge panel 26. The gauge side rail seal 30 is formed of an elastomeric material and has an elongated seal body 32. Typically rail seals are formed using an extrusion process, with the rail seals being formed in sections typically having lengths in the range of 5 to 16 ft. The lengths of the rails seals may vary depending on the particular design and application of the rail seal and on customer preference. The lengths of rail seal are clipped together end-to-end to form the required length.

Figure 2:
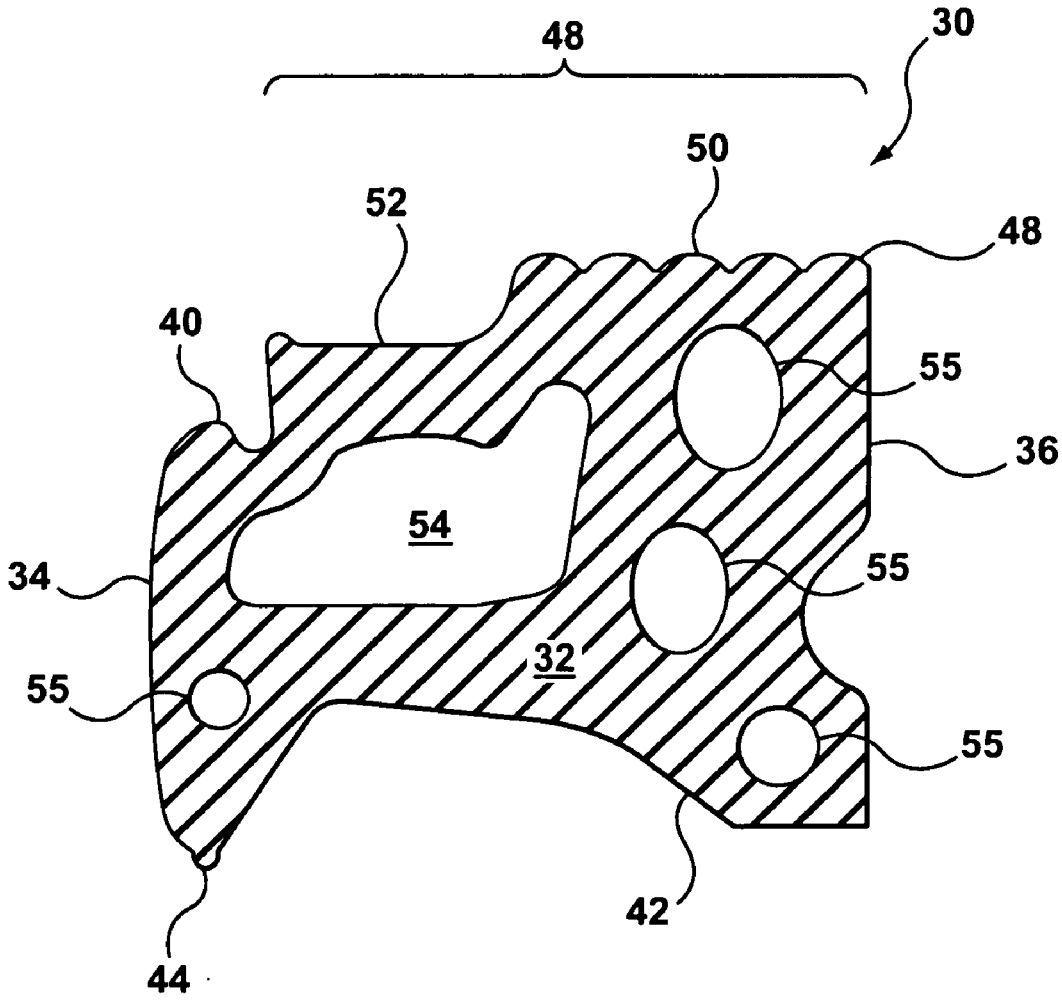
FIG. 2 is a detail cross-sectional view of the gauge side rail seal shown in FIG. 1.

Referring now to FIGS. 1 and 2, the seal body 32 has a first surface 34 formed along the length of the seal body 32 for generally abutting and sealing against the web portion 20 of the inside or gauge side of the corresponding rail 12. A second surface 36 is formed along the length of the seal body opposite to the first surface 34, the second surface 36 for generally abutting and sealing against the corresponding edge of the gauge panel 26. The first surface 34 has an inner lip 40 for engaging the underside or bottom edge 35 of the rail head 16. Inner lip 40 helps to ensure that the gauge-side rail seal 30 is not easily dislodged from engagement with the rail 12 and that it forms an adequate seal with the rail 12.

The seal body 32 has a lower surface 42 formed along the length thereof which has a profile shaped to generally accommodate the rail clips 15 and rail tie fasteners (i.e. bolts or spikes) used to secure the rails 12 in place. The lower surface 42 has a rail-side or inside edge 44 adapted to contact or seal against the base flange 18 of the rail 12 and a gauge-side edge or outside edge 46 which generally rests against or seals against the rail ties or transverse members 14. The lower surface 42, which extends between the inside and outside edges 44, 46, is generally concave in shape so as to accommodate the protrusions associated with the rail clips 15 and rail tie fasteners.

The seal body 32 has an upper surface 48 extending between the gauge panel 26 and the rail head 16 of the corresponding rail 12. The upper surface 48 has a first portion 50 adjacent to the gauge panel 26 and which lies generally in the same plane or at the same surface level as the gauge panel 26 and the upper surface of the rail head 16. The first portion 50 may be generally planar or may have a textured or ribbed surface. A recessed portion or flangeway 52 for receiving the flanged-end or large diameter end of the conically-shaped train wheel is formed within the upper surface 48 of the seal body 32. The flangeway 52 runs generally parallel and adjacent to the rail head 16 along the length of the seal body 32. In standard railroad designs, the flangeway typically has a depth of at least 2 inches and is about 2.5-3 inches wide to accommodate the flanged-end of the train wheel. Accordingly, the standard flangeway generally is deeper than the overall height of the rail head 16 which, as mentioned above, is typically between 1.25-1.5 inches. A typical flange on a train wheel is usually over 1 inch deep; therefore, the standard flangeway is generally deeper than the overall depth of the wheel flange. However, as the both the rail head 16 and the train wheel wear over time, the bottom of the wheel flange will run lower, therefore the additional depth provided by the standard flangeway accommodates for this change over time. In the subject embodiment, the surface of the flangeway 52 lies generally in a plane which lies above the bottom edge 35 of the rail head 16 but below the upper surface of the rail head 16. For instance, the flangeway 52 may have a depth of approximately, but not limited to, 0.875 inches with respect to the first portion 50 of the upper surface 48 of the gauge-side rail seal 30, and may have a width of approximately, but not limited to, 2.5 inches. Therefore, the subject flangeway 52 has a smaller depth than the standard flangeway and is also not as deep as the typical flange found on train wheels. The flangeway 52, therefore, may be considered to be a "shallow" flangeway as it does not provide a deep recess that extends below the rail head 16 for receiving the entire depth of the flanged-end of the train wheel.

A main cavity passage 54 is formed within the seal body 32 along the length thereof. Cavity passage 54 is located generally below the flangeway 52 in the seal body 32 and allows the surface of the flangeway 52 to compress downwardly or deflect away from the rail head 16 under the weight of the passing train to accommodate the entire depth of the flanged-end of the train wheel as the train travels along the tracks. This ensures that the flanged-end of the train wheel adequately engages the rail 12 and rail head 16 to allow the train to be guided along the tracks without risk of derailing due to inadequate engagement between the train wheel and the rail head 16. Therefore, rail seal 30 provides a generally level and even surface across the railway crossing when the rails 12 are being crossed by vehicular and/or pedestrian traffic (including bicycles, wheelchairs, strollers, etc.) while still providing an adequate gap between the rail 12 and the surrounding platform or road surface for receiving the flanged-end of the train wheel as the train travels along the track.

Additional cavity passages 55 may be formed within the seal body 32, as is shown in the drawings. The additional cavity passages 55 are generally formed as a result of the extrusion process typically used to form rail seals of this type. However, in certain applications where additional compressibility or flexibility of the rail seal is required, additional cavity passages 55 are formed in the rail seal 30 to provide further flexibility to the flangeway 52 so as to reduce the tendency of the rail seal to pull in from the gauge side panel surface 26 when the flangeway 52 is deflected, or to modify the path of deflection of the flangeway 52. More specifically, in certain instances, additional cavity passages are provided to assure that the rail seal compresses in such a manner that the inner lip 40 of the gauge-side rail seal 30 does not get caught under the rail head 16 without being able to rebound properly to maintain a proper seal once the train has passed.

Therefore, when the gauge-side rail seal 30 is positioned within the gap between the gauge panel 26 and the corresponding rail 12, the rail seal 30 provides a generally, relatively even and continuous surface between the rails 12 and the surrounding surface thereby significantly reducing the risks and hazards for vehicular and other pedestrian traffic (i.e. bicycles, strollers, wheelchairs, etc.) that generally exist at railway or streetcar crossings while still providing an adequate gap to accommodate the flanged-end of the train wheel to ensure safe passage of the passing train or streetcar.

Rail seals having an upper surface formed generally at the same level as the upper surface of the surrounding platform or road surface and the rail head (i.e. a rail seal with no form of recess or flangeway formed in the upper surface), are known. These types of rail seals offer the advantage of providing a continuous, even surface between the rails and surrounding area (or other surface material), which significantly reduces the risk of tripping or injury as discussed above. It is for this reason that rail seals of this type are particularly advantageous in train car workshops or repair areas, etc. since there is high traffic of workmen/mechanics, etc. walking around the train cars as well as various small-wheeled tools and tool carts being pushed around the area which could easily become stuck in any sort of gap or recess adjacent the rails. However, despite their advantages in terms of preventing tripping, etc., this type of rail seal is limited to use in areas where the trains or rail cars are either stopped or only moving at very slow speeds (i.e. in repair areas). The rail seals with a continuous, even upper surface are generally limited to this particular use since having no visible or physical flangeway in the rail seal for allowing the train wheel to engage the rail head and be guided along the track increases the risk of possible derailment of the train, especially at high speeds. A flangeway not only helps to ensure proper engagement of the train wheel but it also provides a visual guide for the driver of the train (or streetcar). Therefore, while rail seals having a continuous, even upper surface (i.e. with no recess or flangeway) provide the advantage of preventing tripping, etc. since no gap or recess exists between the rail and the surrounding area, this type of rail seal is generally unacceptable for use in railroad or streetcar crossings in public areas where trains are generally travelling at higher speeds. Accordingly, these "continuous" rail seals do not address the problems associated with the structure of public railroad or streetcar crossings where the crossing is used by vehicular and/or pedestrian traffic.

Figure 3:
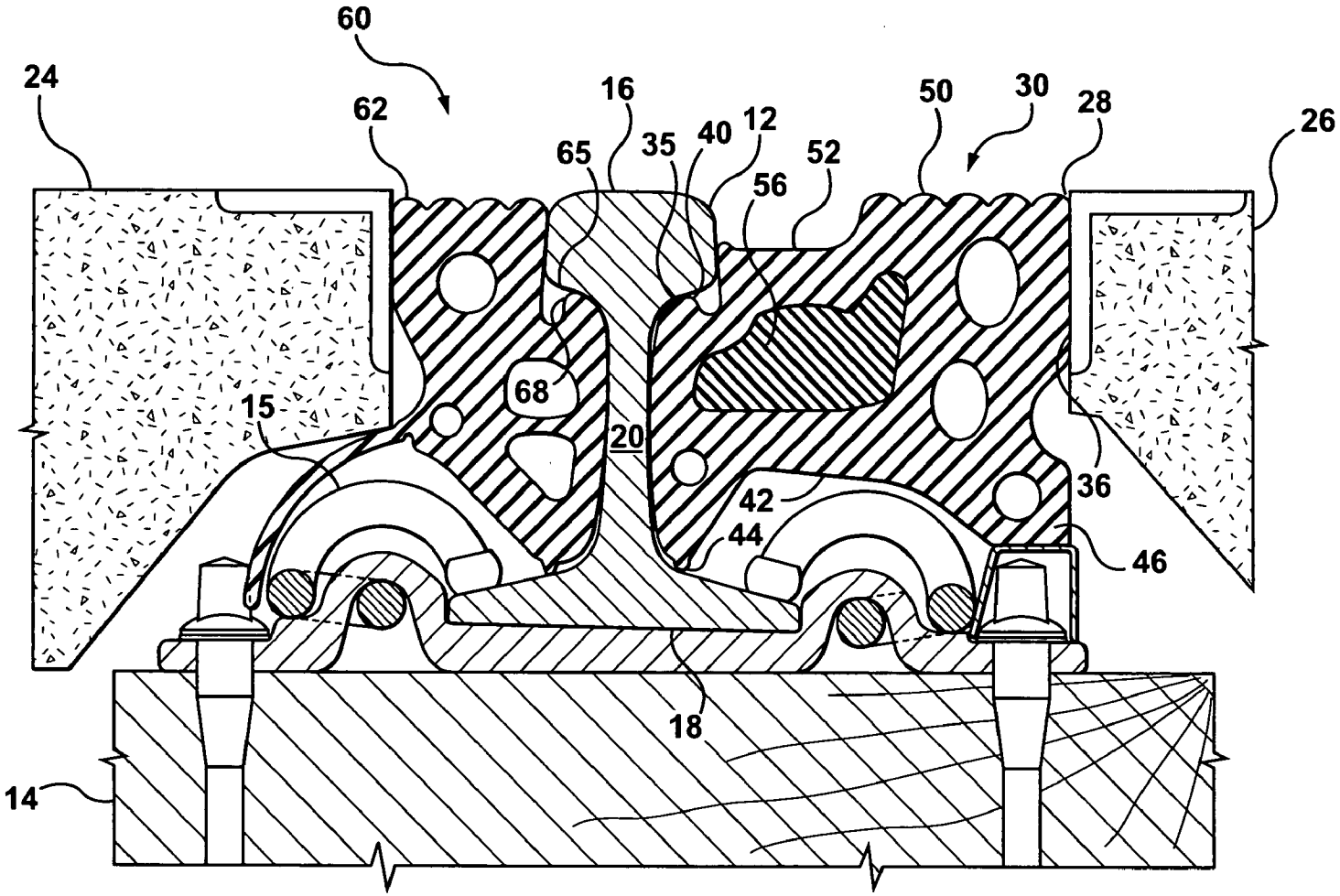
FIG. 3 is a cross-sectional view of a portion of a railway crossing structure incorporating a rail seal according to another example embodiment of the present disclosure.

Referring now to FIG. 3, there is shown another example embodiment of the rail seal according to the present disclosure. In this embodiment, cavity 54 is filled with a compressible material 56, such as a closed-cell foam, in order to ensure that the cavity 54 does not become clogged with dirt and/or debris which could build-up over time and prevent the flangeway 52 from being able to compress to accommodate the flanged-end of the train wheel. During winter weather conditions, the compressible material or foam 56 also helps to prevent ice build-up within the cavity which could have the same detrimental effects to the proper functioning of the rail seal should the cavity 54 become blocked to the point that the flangeway 52 was no longer able to compress. However, it will be understood that while having the cavity 54 filled with a compressible material 56 may be particularly suitable for specific applications, it is not necessarily essential to the functioning of the gauge side rail seal 30 since the normally enclosed or embedded nature of the cavity 54 within the seal body 32 itself inherently helps to prevent the potential build-up of dirt, ice or debris.

Figure 6:
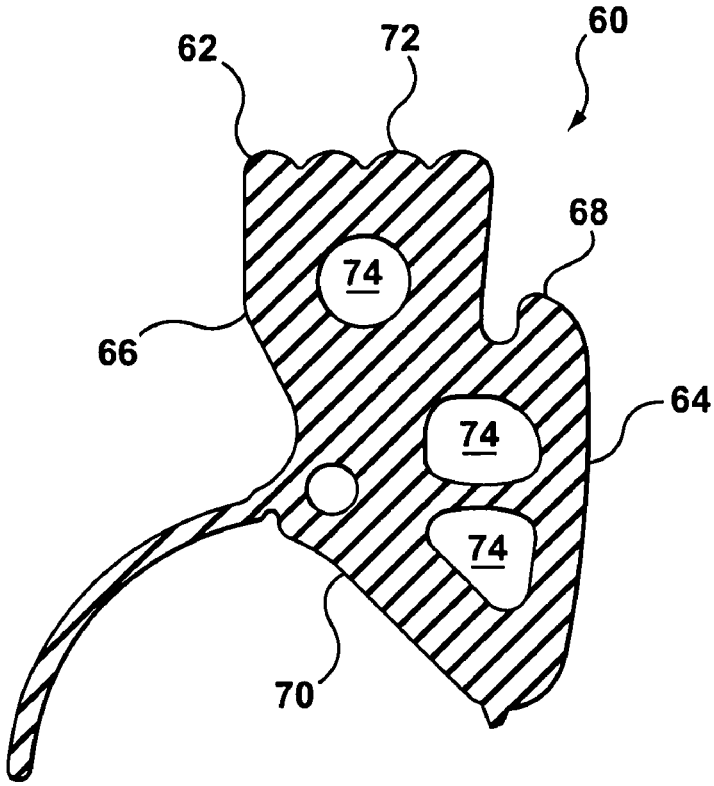
FIG. 6 is a detail cross-sectional view of the field-side rail seal shown in FIGS. 1 and 3.
Figure 7:
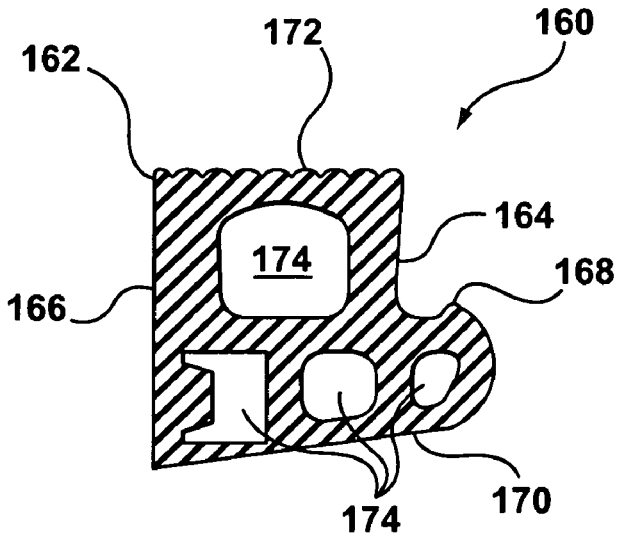
FIG. 7 is a detail cross-sectional view of the field-side rail seal shown in FIG. 4.

Referring now to FIGS. 1, 3 and 6, in addition to the gauge-side rail seal 30, the railway crossing structure according to any of the above-described embodiments may also include a field-side rail seal 60 as is known in the art. The field-side rail, seal 60 is positioned between the field-side of the rail 12 and the corresponding concrete field panel 24. The field-side rail seal 60 is formed of an elastomeric material and has an elongated seal body 62. The seal body has a first surface 64 formed along the length of the seal body 62 for generally abutting and sealing against the outside or field-side of the web portion 20 of the rail 12. A second surface 66 is formed along the length of the seal body 62 opposite to the first surface 64 for generally abutting and sealing against the edge of the field panel 24. Similar to the gauge-side rail seal 30, the first surface 64 of the field-side rail seal 60 is formed with an inner lip, 68 for engaging the underside or bottom outside edge 65 of the rail head 16 for ensuring that the rail seal 60 engages the rail head 16 to provide an adequate seal.

The seal body 62 of the field-side rail seal 60 has a lower surface 70 formed along the length thereof which is shaped to generally accommodate and/or surround the rail clips 15 and rail tie fasteners that are used to secure the rails 12 in place. Accordingly, as shown in the drawings, the lower surface 70 has a generally concave shape to accommodate the protruding portions of the rail clips 15 and rail tie fasteners. The seal body 62 has an upper surface 72 extending between the concrete field panel 24 and the rail head 16 of the corresponding rail 12 which lies generally in the same plane or at the same surface level as the concrete field panel 24 and the upper surface of the rail head 16. The upper surface 72 of the field-side rail seal 60 provides a generally continuous surface between the concrete surround and the rails 12 in the railway crossing. Various cavity passages 74 may be formed within the seal body 62 along the length thereof; however, these passages 74 are typically formed as part of the extrusion process to form the rail seal 60.

Figure 4:
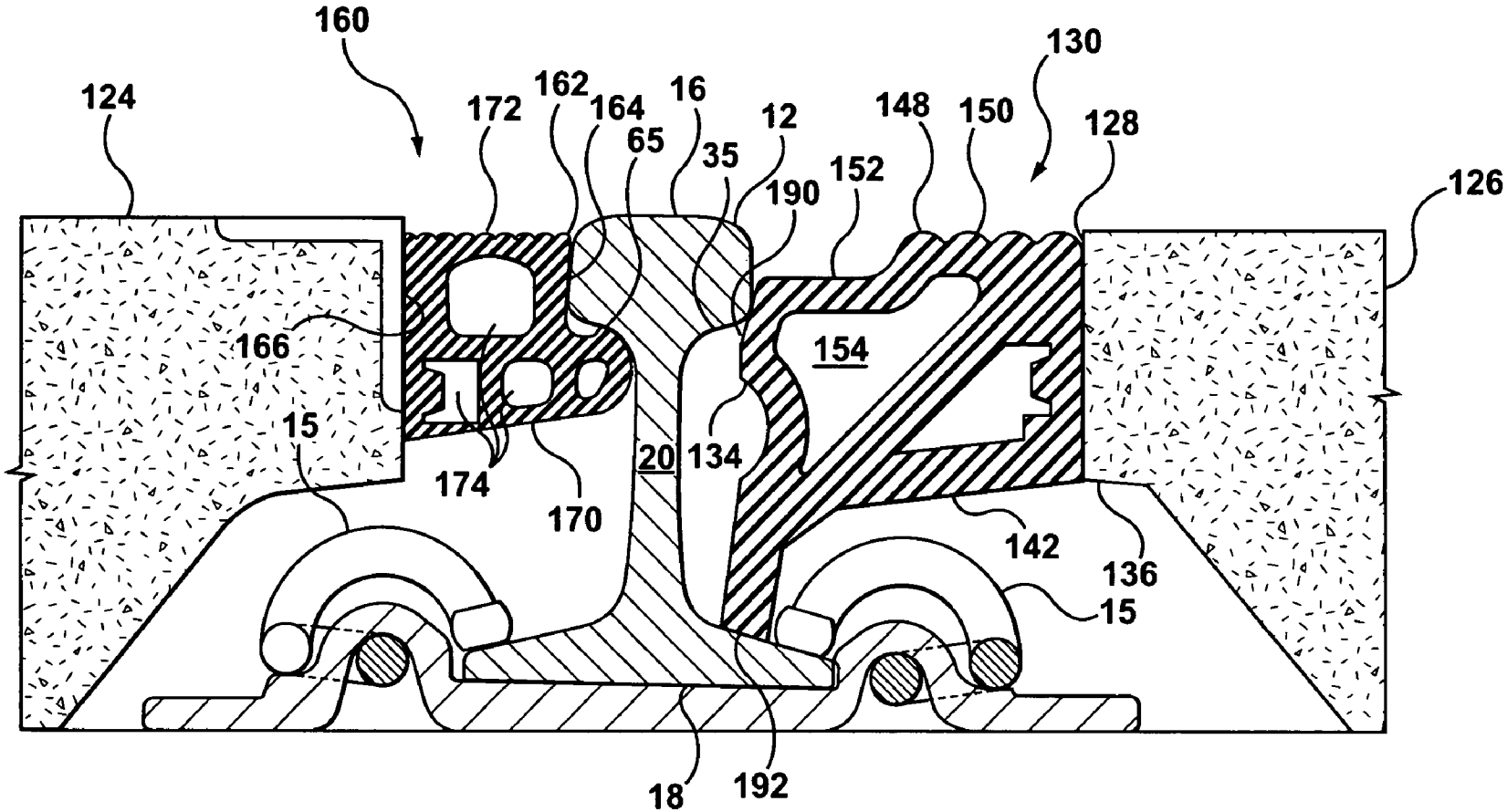
FIG. 4 is a cross-sectional view of a portion of a railway crossing structure incorporating a rail seal according to another example embodiment of the present disclosure.
Figure 5:
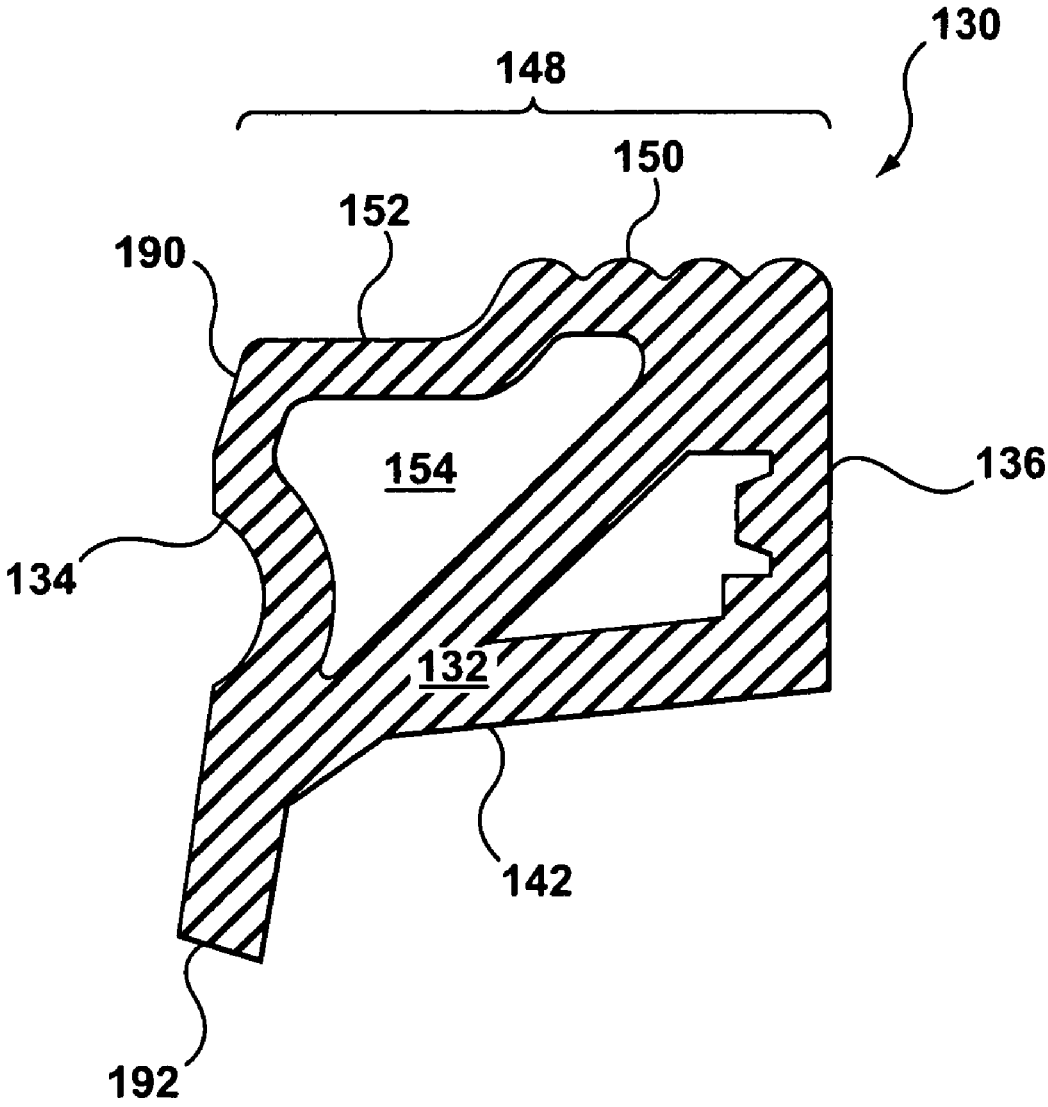
FIG. 5 is a detail cross-sectional view of the gauge-side rail seal shown in FIG. 4.

Referring now to FIG. 4, there is shown another example embodiment of a rail seal according to the present disclosure wherein like reference numerals, increased by a factor of 100, have been used to identify similar features. In this example embodiment, the surrounding platform or area is formed of concrete panels and the gauge-side rail seal 130 is formed so it can be attached to the concrete gauge panel 126 with the two components being mounted within the railroad or streetcar crossing structure as a single unit rather than the rail seal being mounted separately to the surrounding gauge panel and positioned or fitted within the gap provided between the rail 12 and the gauge panel 26, as previously described. Typically, the rail seal 130 is bolted to or cast into the edge of the concrete gauge panel 126.

As shown in FIG. 4, rail seal 130 is formed of an elastomeric material and has an elongated seal body 132. The seal body 132 has a first surface 134 formed along the length thereof. The first surface 134 extends between first and second ends 190, 192. The first end 190 contacts or generally abuts a bottom of the rail head 16 and the second end 192 contacts and rests against a portion of the base flange 18 of the rail 12. Therefore, the first surface 134 does not necessarily abut or seal against the web portion 20 of the rail. The seal body 132 has a second surface 136 generally opposite to the first surface 132 formed along the length of the seal body 132. The second surface 136 may be in the form of a generally planar surface when the rail seal is bolted to the corresponding edge of the concrete gauge panel 126. When the rail seal 130 is cast directly into the corresponding edge of the concrete gauge panel 126, the second surface 136 is formed with an anchoring protrusion (not shown) which is extruded into the rubber rail seal, as is known in the art. The anchoring protrusion helps to ensure a secure inter-connection between the rail seal 130 and the corresponding concrete gauge panel 126. As shown in the drawing, the second surface 136 does not extend the entire depth of the gap 128 so as to contact the rail clips 15 or rail tie members, as in the previously described embodiment. The second surface 136 generally only extends so as to correspond to the length of the inner edge of the concrete gauge panel 126.

Seal body 132 has a lower surface 142 extending between the second end 192 of the first surface 134 and the lower end of the second surface 136. The lower surface 142 is generally shaped so as to accommodate the protruding components of the rail clips 15 and/or rail tie fasteners used to secure the transverse members 14 (or rail ties) in place.

The seal body 132 has an upper surface 148 which extends between the concrete gauge panel 126 and the rail head 16 of the corresponding rail 12. As in the above-described embodiments, the upper surface 148 has a first portion 150 which lies generally in the same plane or at the same surface level as the concrete gauge panel 126 and the upper surface of the rail head 16, and a flangeway or recessed portion 152 which runs adjacent and parallel to the rail 12 along the length of the rail seal 132. The flangeway or recessed portion 152 is adapted to receive the flanged-end or large diameter end of the train wheel and lies generally in a place which lies above the bottom edge 35 of the rail head 16 but below the upper surface of the rail head 16 as described above in connection with FIGS. 1 and 2.

A main cavity passage 154 is formed within the seal body 132 along the length thereof. As previously described, the cavity passage 154, which is generally aligned with and located below the flangeway 152, allows the flangeway 152 to compress downwardly or deflect away from the rail head 16 under the weight of the passing train. This allows the flangeway 152 to deform sufficiently so that the flanged-end of the train wheel can fully engage the rail 12, as described in further detail above. It will be understood that cavity passage 154 may also be filled with a compressible material 156 as described above in connection with the specific embodiment shown in FIG. 3.

In this embodiment, the field-side rail seal 160 is also formed so that it can be attached to the concrete field panel 124 and mounted in the railroad or streetcar crossing as a singular unit. Accordingly, the field-side rail seal 160 has a first surface 164 formed along the length of the seal body 162 for generally abutting and sealing against at least a portion of the rail 12, the first surface 164 having an inner lip 168 for engaging the underside or bottom outside edge 65 of the rail head 16. This helps to ensure that the field-side rail seal 160 adequately engages and seals with the corresponding rail 12. The second surface 166 is adapted to be bolted or cast directly into the corresponding edge of the concrete field panel 124, as is known in the art. In the subject embodiment, the field-side rail seal 160 does not extend the full depth of the gap provided between the rail 12 and the concrete field panel 24 and, therefore, does not contact the rail base 18 or any of the rail clips 15 or transverse members 14.

The field-side rail seal 160 has a lower surface 170 which, in the subject embodiment, is a generally planar surface. As in the previously described embodiment, the upper surface 172 of the rail seal 160 extends between the concrete field panel 24 and the rail head 16 of the corresponding rail 12 and lies generally in the same plane or at the same level as the field panel 24 and the upper surface of the rail head 16. Therefore the field-side rail seal 160 provides a generally even, continuous surface between the rail 12 and the corresponding concrete panel 124 as is typical of field-side rail seals. While the field-side rail seal 160 is shown with various cavity passages 174 formed therein, these passages are generally formed as a result of the extrusion process used to form rail seals of this type.

Figure 8:
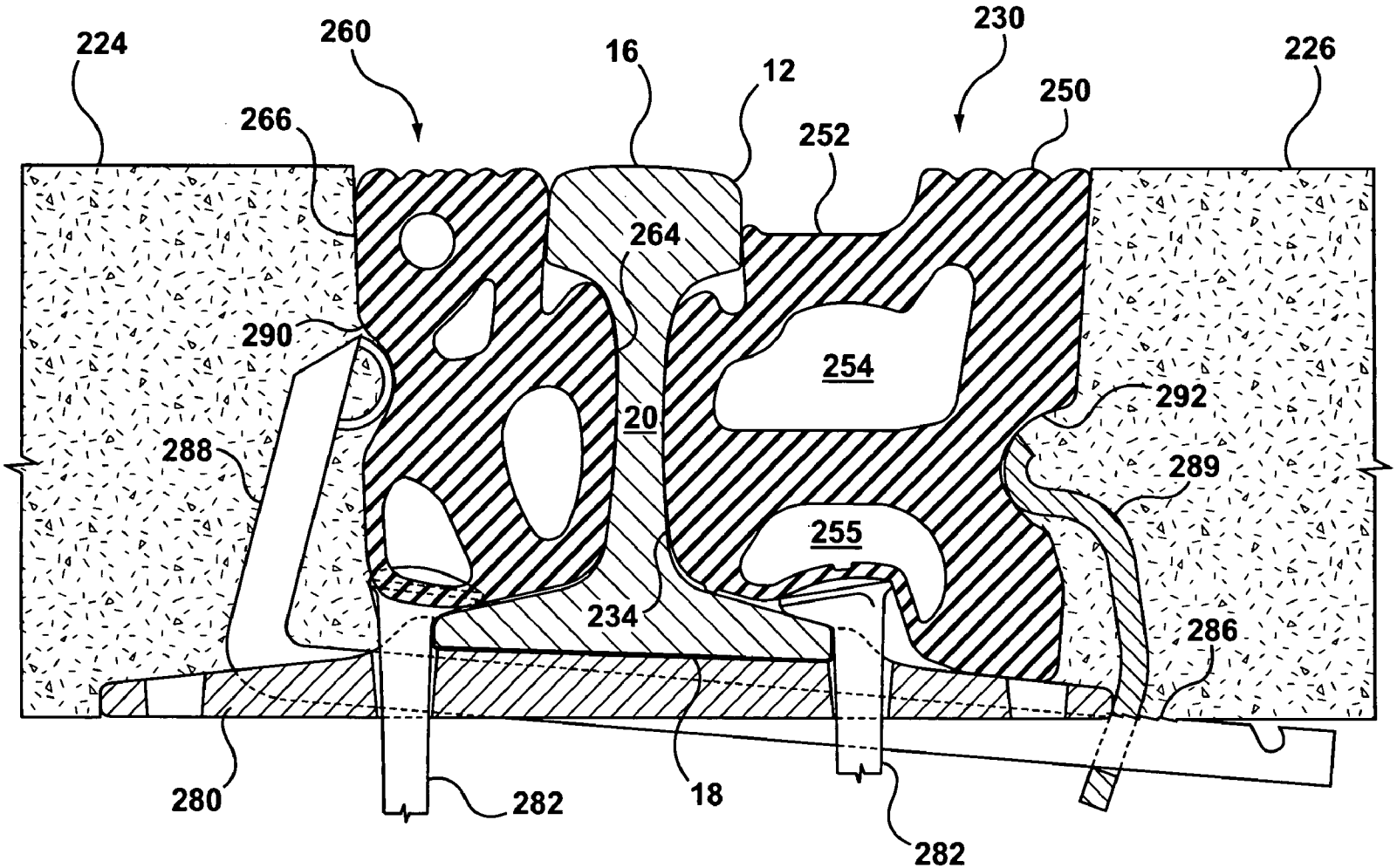
FIG. 8 is a cross-sectional view of a portion of a railway crossing structure incorporating a rail seal according to another example embodiment of the present disclosure.

Referring now to FIG. 8, another example embodiment of a railway or streetcar crossing structure according to the present disclosure is shown wherein like reference numerals, increased by a factor of 200, have been used to identify similar features. In the subject embodiment, the rails 12 are incorporated into a road surface made of poured asphalt. Each rail 12 (only one of which is shown) is mounted on and held in place by a tie plate 280 which is secured with spikes or rail tie fasteners 282 to transverse members (not shown), as is known in the art. Gauge-side and field-side rail seals 230, 260 are positioned on either side of the rail 12, with the first surfaces 234, 264 of each rail seal 230, 260 generally abutting and sealing against the web portion 20 of the rail 12, as in the example embodiment shown in FIG. 1. A clamping mechanism or clip structure 286 is used to hold the rail seals 230, 260 in position with respect to the rail 12 and tie plate 280. The clamping mechanism has a first clamping member 288 that engages the second surface 266 of the field-side rail seal 260 and is driven under the rail base and tie plate 280, and a second clamping member 289 that engages the second surface 236 of the gauge-side rail seal 230. Accordingly, both the second surfaces 234, 266 of the gauge-side and field-side rail seals 230, 260 have a corresponding anchoring recess 290, 292 formed therein for receiving the corresponding portion of the clamping members 288, 289. With the gauge-side and field-side rail seals 230, 260 securely in position, the asphalt road surface can be poured between and on either side of the rails 12 to form the surrounding road surfaces 226, 224. The gauge-side rail seal 230 is similar in structure to the gauge-side rail seal shown in FIGS. 1 and 2, with the upper surface 248 having a first portion 250 lying generally at the same level as the gauge-side asphalt surround 226 and a recessed portion or flangeway 252 formed adjacent to and extending generally parallel to the rail head 16 with the flangeway 252 lying in a plane generally above the bottom edge 35 of the rail head 16 but below the upper surface of the rail head 16. Therefore, as described above, the flangeway 252 generally has a depth of approximately, but not limited to, 0.875 inches with respect to the first portion 250 or the surface of the asphalt surround 226. Therefore, the flangeway 252 has a depth that is generally less than the actual depth of the standard 1 inch flange found on most train wheels. However, as described above, the main cavity 254 allows the flangeway 252 to compress or deflect away from the rail head 16 under the weight of the passing train to ensure proper engagement of the wheel flange with the rail 12, while the shallow flangeway 252 provides a more even surface across the surface of the crossing thereby reducing the risks associated with having larger, deeper gaps or recesses adjacent the rails 12.

Accordingly, it will be understood that the rail seal according to the present disclosure can be used in various types of rail crossings. More specifically, the rail seals can be incorporated into rail crossings that form part of a poured asphalt road surface, or into rail crossings having concrete panel surrounds or other road surface material.

Furthermore, the various embodiments presented above are merely examples and are in no way meant to limit the scope of this disclosure. Variations of the innovations described herein will be apparent to persons of ordinary skill in the art, such variations being within the intended scope of the present application.

The subject matter described herein and in the recited claims intends to cover and embrace all suitable changes in technology.

The invention claimed is:

1. A rail seal for a railroad crossing, the rail seal for sealing a gap between a rail and a surrounding road surface or platform of a railroad or streetcar crossing, the rail having a rail head, a rail base and a web portion interconnecting the rail head and rail base, the rail seal comprising:

an elongated elastomeric seal body;

a first surface formed along the length of the seal body for generally abutting a gauge side of the rail;

a second surface formed along the length of the seal body generally opposite to said first surface, the second surface generally abutting a corresponding edge of the surrounding road surface of the railroad crossing; and a flangeway formed in an upper surface of the seal body along the length thereof, the flangeway including a substantially horizontal surface for receiving a flanged wheel of a train;

wherein the substantially horizontal surface lies in a plane above the bottom of the rail head but below the upper surface of the rail head.

2. A rail seal as claimed in claim 1, wherein the flangeway is compressible such that the flangeway lies generally in a plane below the bottom of the rail head in response to the flanged wheel of a passing train.

3. A rail seal as claimed in claim 1, wherein the flangeway is compressible such that the flangeway achieves a depth that corresponds to the depth of the flanged train wheel.

4. A rail seal as claimed in claim 1, further comprising a cavity passage formed within the seal body along the length thereof, the cavity passage being generally aligned with and formed generally below the flangeway to allow for compression of the rail seal away from the rail head.

5. A rail seal as claimed in claim 4, wherein said cavity passage is filled with a closed cell foam material.

6. A rail seal as claimed in claim 4, wherein additional cavity passages are formed within the seal body, the additional cavity passages further increasing the compressibility of the rail seal.

7. A rail seal as claimed in claim 1, wherein the elongated elastomeric seal body is formed by extrusion.

8. A rail seal as claimed in claim 1, wherein the first surface abuts and seals against the web portion of the rail.

9. A rail seal as claimed in claim 1, wherein the upper surface is formed with a first portion extending between the second surface and the flangeway, the first portion lying generally in the same plane as the surrounding road surface and the upper surface of the rail head.

10. A rail seal as claimed in claim 9, wherein the first portion is a ribbed surface.

11. A rail seal as claimed in claim 1, wherein the rail seal is cast directly into the corresponding edge of the surrounding road surface.

12. A rail seal as claimed in claim 1, wherein the rail seal is bolted to the corresponding edge of the surrounding road surface.

13. A rail seal as claimed in claim 1, wherein the surrounding road surface is asphalt, the asphalt being poured so as to contact and abut the second surface of the rail seal.

14. A railway crossing structure comprising:

a pair of rails, each rail having a rail head, a base flange and a web portion interconnecting the rail head and the base flange;

a plurality of rail ties secured transversely between the rails;

a gauge panel positioned on a gauge side of the rails, the gauge panel forming a first gap between an edge of the panel and the gauge side of the corresponding rail;

a pair of field panels, each field panel positioned on a field side of a corresponding rail, each field panel being spaced away from the corresponding rail to form a second gap;

a gauge-side rail seal positioned within each first gap, the gauge-side rail seal comprising:

an elongated elastomeric seal body;

a first surface formed along the length of the seal body for generally abutting a gauge side of the rail;

a second surface formed along the length of the seal body generally opposite to said first surface, the second surface generally abutting a corresponding edge of the gauge panel; and a flangeway formed in an upper surface of the seal body along the length thereof, the flangeway including a substantially horizontal surface for receiving a flanged wheel of a train;

wherein the substantially horizontal surface lies in a plane above the bottom of the rail head but below the upper surface of the rail head.

15. A railroad crossing structure as claimed in claim 14, wherein a field-side rail seal is positioned within each second gap.

16. A railroad crossing structure as claimed in claim 14, wherein said field panels and said gauge panels are concrete panels.

17. A railroad crossing structure as claimed in claim 14, wherein said field panels and gauge panels are formed of poured asphalt.

18. A railroad crossing structure as claimed in claim 14, wherein the flangeway of the gauge-side rail seal is compressible such that the flangeway lies generally in a plane below the bottom of the rail head in response to the flanged wheel of a passing train, the flangeway achieving a depth that corresponds to the depth of the flanged train wheel.

19. A railroad crossing structure as claimed in claim 14, wherein the gauge-side rail seal further comprises at least one cavity passage formed within the seal body along the length thereof, the at least one cavity passage being generally aligned with and formed generally below the flangeway to allow for compression of the rail seal away from the rail head.

20. A railroad crossing structure as claimed in claim 14, wherein the railroad crossing structure is a street car crossing.

* * * * *

UNITED STATES PATENT AND TRADEMARK OFFICE

CERTIFICATE OF CORRECTION

PATENT NO. : 8,100,342 B1
APPLICATION NO. : 12/826761
DATED : January 24, 2012
INVENTOR(S) : Bruce E. Burkhardt and Richard T. Ellis It is certified that error appears in the above-identified patent and that said Letters Patent is hereby corrected as shown below:

Title page, item [73] delete "Assignee: Polycorp Inc., Toronto (CA)"

and insert: --Assignee: Polycorp LTD, Toronto (CA)--

Signed and Sealed this
Twenty-ninth Day of May, 2012

David J. Kappos

David J. Kappos
*Director of the United States Patent and Trademark Office*